US005240041A

United States Patent [19]

Garnjost

[11] Patent Number: 5,240,041

[45] Date of Patent: Aug. 31, 1993

[54] SYNTHESIZED FLOW-CONTROL SERVOVALVE

[75] Inventor: Kenneth D. Garnjost, Buffalo, N.Y.

[73] Assignee: Moog Inc., East Aurora, N.Y.

[21] Appl. No.: 852,913

[22] Filed: Mar. 13, 1992

Related U.S. Application Data

[63] Continuation of Ser. No. 622,223, Dec. 3, 1990, abandoned, which is a continuation of Ser. No. 459,733, Dec. 28, 1989, abandoned.

[51] Int. Cl.[5] ..... F15B 13/043

[52] U.S. Cl. ..... 137/625.62; 91/433; 137/625.64

[58] Field of Search ..... 91/433; 137/625.62, 137/625.64

[56] References Cited

U.S. PATENT DOCUMENTS

| | | | |
|---|---|---|---|
| 2,931,389 | 4/1960 | Moog et al. | 137/625.62 |
| 2,953,123 | 9/1960 | Reen et al. | 137/625.64 X |
| 2,964,059 | 12/1960 | Geyer | 137/625.62 |
| 3,390,615 | 7/1968 | Hayner et al. | 91/359 |
| 3,464,318 | 9/1969 | Thayer et al. | 137/625.62 X |
| 3,555,970 | 1/1971 | Borgeson et al. | 137/625.64 X |
| 3,757,823 | 11/1973 | Knutson | 137/625.64 |
| 4,061,155 | 12/1977 | Sophia | 137/625.62 X |
| 4,456,031 | 6/1984 | Taplin | 137/625.64 X |
| 4,623,003 | 11/1986 | Leonard | 137/625.62 X |
| 4,635,682 | 1/1987 | Walters | 137/625.64 |
| 4,938,118 | 7/1990 | Wolfges et al. | 91/433 X |

FOREIGN PATENT DOCUMENTS 0098719 1/1984 European Pat. Off. .

*Primary Examiner*—Gerald A. Michalsky

*Attorney, Agent, or Firm*—Sommer, Oliverio & Sommer

[57] ABSTRACT

An improved two-stage servovalve (70) has a pilot-stage and an output-stage. A torque motor (16) produces pivotal movement of a flapper (18) in response to a supplied electrical current. The pilot-stage produces a flow which is used to selectively displace a second-stage spool (61) relative to a body bore. The servovalve has a hydromechanical pressure feedback loop closed about the load and second-stage spool. The pressure feedback loop is intertwined with an electrical spool position feedback loop closed about the spool and driver. The command to the pressure loop is a function of the error of the spool position loop. The gain of the spool position loop dominates that of the pressure loop. The valve has pressure-flow characteristics approximating those of a "flow-control" servovalve but affords access to an electrical signal substantially proportional to the load pressure differential.

10 Claims, 5 Drawing Sheets

SYNTHESIZED FLOW-CONTROL SERVOVALVE

This is a continuation of copending U.S. application Ser. No. 07/622,223, filed on Dec. 3, 1990, now abandoned, which was a continuation of copending U.S. application Ser. No. 07/459,733, filed Dec. 28, 1989, now abandoned.

TECHNICAL FIELD

This invention relates generally to the field of electrically-controlled servovalves, and, more particularly, to an improved two-stage electrohydraulic servovalve having pressure-flow characteristics approximating those of a conventional "flow-control" servovalve but nevertheless affording access to an electrical signal proportional to the load pressure differential.

BACKGROUND ART

An electrohydraulic servovalve is basically a device for converting an electrical input signal into a proportional hydraulic output.

In a two-stage servovalve, a first- or pilot-stage is used as a hydraulic amplifier to selectively displace a second- or output-stage valve spool relative to a body. The pilot-stage typically has a torque motor operatively arranged to vary the position of a member in proportional response to a supplied electrical current. This member may be a flapper positioned between a pair of opposed nozzles, a deflector-jet, a jet pipe, or the like. In any event, the pilot-stage is employed to produce a pressure differential proportional to the supplied current, which differential is then applied to the end faces of the second-stage valve spool and used to selectively displace the spool relative to the body. Thus, the pilot-stage pressure differential creates a force which urges the valve spool to move from an equilibrium position, while the flow into the expanding spool end chamber and from the contracting spool end chamber determines the velocity of the spool relative to the body. The spool is, in turn, operatively arranged to control the hydraulic output (i.e., pressure, flow, etc.) of the servovalve.

Such servovalves are also classified by type. See, e.g., Technical Bulletin 103, "Transfer Functions for Moog Servovalves", Moog Inc. (1965). For example, a "flow-control" servovalve is one in which flow through the second-stage at constant load is substantially proportional to the supplied electrical current. These valves typically have a spool position feedback loop closed about the spool and torque motor such that the magnitude of spool displacement off null will be substantially proportional to the magnitude of the supplied current. The direction of spool displacement is determined by the polarity of the supplied current. The feedback mechanism may be in the form of a mechanical spring wire connecting the spool with the flapper (See, e.g., U.S. Pat. No. 3,023,782), or in the form of centering springs operatively positioned in the spool end chambers, or may be electrical (see, e.g., U.S. Pat. No. 3,752,189). Thus, in such a "flow-control" servovalve, the magnitude of spool displacement off null is substantially proportional to the magnitude of the supplied current. The effect of such spool displacement is to create ports or orifices through which fluid may flow. The area of such ports or orifices is generally proportional to the magnitude of spool displacement. However, flow through the second-stage is a function of such orifice area and the pressure differential there-across. Hence, if the load is constant, the pressure differential across the second-stage ports will normally be constant, and flow will be proportional to spool displacement and input current. On the other hand, if such pressure differential varies (e.g., as by the load varying), then flow through the second-stage will also vary. Nevertheless, this type of valve is commonly referred to as a "flow control" valve because, at constant load (i.e., at constant pressure differential) second-stage flow is substantially proportional to the supplied current.

In a "pressure-control" servovalve, the hydraulic output of the second-stage is a differential pressure provided to the load. Thus, a four-way "pressure-control" servovalve will produce a differential pressure output proportional to the supplied current. This type of valve is structurally similar to a "flow-control" valve, except that the spool position feedback loop is omitted, and a pressure feedback loop is closed about the second-stage spool and the load (see, e.g., U.S. Pat. No. 2,931,389). In effect, the current supplied to the torque motor causes a first axial force to be applied to the spool. However, the load pressure differential exerts an opposing second force on the spool. These two forces equal one another when the load pressure differential equals the torque motor-produced differential. However, there is typically no feedback connection between the spool and the torque motor, such as a spring wire or centering springs in the case of a "flow-control" servovalve, and the second-stage spool will move to an equilibrium position relative to the body at which such opposing fluid forces balance one another.

A "pressure-flow" (PQ) control servovalve is somewhat of a hybrid design, which combines the functions of pressure and flow control and contributes effective damping in highly-resonant loaded servosystems. Flow from these servovalves is determined not only by the magnitude of the supplied electrical current, but also by the differential load pressure. Such PQ servovalves have been provided with a pressure feedback loop (i.e., as in the case of a "pressure-control" servovalve), and with a mechanical spool position feedback loop (i.e., as in the case of a "flow-control" servovalve). Such PQ servovalves have heretofore been deliberately designed to have pressure-flow characteristics intermediate those of a conventional "flow-control" and "pressure-control" servo-valves. As will be demonstrated infra, a "flow-control" servovalve has a high pressure gain at low currents. While this is desirable in some applications (e.g., to overcome threshold or static friction), it can produce problems in others. For example, if two "flow control" servovalves are used in parallel to control the position of a common load, a differential in the pressure-to-current gains of the valves can produce force-fighting between the valves. As indicated above, such pressure gain varies inversely with current in conventional "flow-control" valves. In other words, for small currents, the pressure gains are high and the problem of force-fighting between the valves is amplified. Because of this, the PQ valve was developed largely to reduce the pressure gain at small currents and to provide a valve suitable for use in such redundant or tandem applications.

In some actuator systems, it is sometimes desired to provide for redundant operation. This is common in aircraft applications, particularly with the advent of fly-by-wire control systems. Various types of redundant control systems are shown and described in Technical Bulletin 105, "New Servovalves for Redundant Electrohydraulic Control", Moog Inc. (1963). In such redundant control systems, it is generally desired to equalize the operation of multiple servovalves so as to avoid force-fighting therebetween at the actuator.

DISCLOSURE OF THE INVENTION

This invention provides an improved electrically-controlled servovalve, which is particularly adapted for use in redundant servosystems, in which a variant form of a "pressure-flow" servovalve has pressure-flow characteristics approximating those of a conventional "flow-control" servovalve, but which affords access to an electrical signal which is substantially proportional to the load pressure differential.

The improved servovalve has two intertwined feedback loops. A pressure feedback loop is closed about the load and a valve member (e.g., a second-stage valve spool). A position feedback loop is closed about the member and the driver (e.g., the torque motor, etc.). These two loops are arranged such that the command to the pressure loop is preferably electrical so that its gain may be high and easily adjusted. The gain of the position loop is selected such that it dominates the gain of the pressure loop. Hence, the improved valve has pressure-flow characteristics which approximate those of a conventional "flow-control" servovalve, valve, but which affords access to an internal electrical signal (i.e., the command to the pressure loop) which is substantially proportional to the load pressure differential. Hence, for example, the improved servovalve is particularly useful in, but not limited to, applications wherein the operation of multiple servovalves are to be related to one another.

Hence, the invention provides an improvement in an electrically-controlled servovalve having a valve member (e.g., a valve spool, a rotary vane, etc.) movable relative to a body to control the flow of a fluid (e.g., a liquid or a gas) with respect to a load (e.g., a conventional fluid-powered actuator, such as a piston-and-cylinder, to which an external force may be applied), and having an electrically-powered driver (e.g., a conventional torque motor, an electromagnetic actuator, a piezoelectric device, etc.) adapted to be supplied with a suitable electrical signal (e.g., a current of desired polarity and magnitude in the case of a device having a coil, an appropriate voltage in the case of a piezoelectric device, etc.) and operatively arranged to exert a first force (e.g., fluidic, electromechanical, electro-expansive, etc.) on the member in response to the signal for urging the member to move in one direction relative to the body.

In one aspect, the improvement includes: a pressure feedback loop closed about the member for exerting a second force on the member which opposes the first force such that the pressure applied to the load will be substantially proportional to the command to the pressure loop; and an electrical position feedback loop closed about the member and the driver such that the command to the pressure loop will be a function of the error in the position loop. This function may be a proportional relationship, but it need not necessarily be so.

In another aspect, the improvement provides such a servovalve with pressure and position feedback loops which are intertwined such that the command to the pressure loop is a function of the error of the position loop, with the gain of the position loop so dominating the gain of the pressure loop, that the pressure-flow characteristics of the valve approximate those of a conventional "flow-control" servovalve, but which nevertheless affords access to an electrical signal (i.e., the command to the pressure loop) within the spool position feedback loop which is substantially proportional to the differential load pressure. Hence, the improved servovalve outwardly simulates the performance characteristics of a "flow-control" servovalve, but allows load pressure differential to be readily and continually monitored.

Accordingly, the general object of the invention is to provide an improved electrically-controlled servovalve.

Another object is to provide an improved electrically-controlled servovalve which simulates the pressure-flow characteristics of a "flow-control" servovalve, but which allows the load pressure differential to be monitored as a function of an intermediate electrical signal.

These and other objects and advantages will become apparent from the foregoing and ongoing written specification, the drawings, and the appended claims.

MODE(S) OF CARRYING OUT THE INVENTION

Figure 1C:
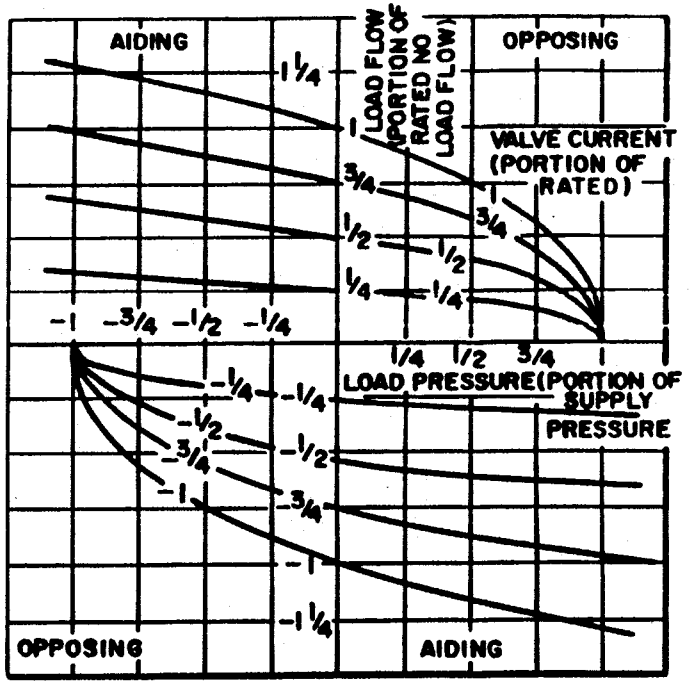
Fig. 1C. (PRIOR ART)
FIG. 1C is a plot of the pressure-flow characteristics of the "flow-control" servovalve shown in FIG. 1A.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are intended to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

This invention broadly provides an improved electrically-controlled servovalve, of which a two-stage electrohydraulic servovalve is only one particular species. Hence, while the invention will be illustrated and described with respect to such species, it should be clearly understood that the improvement if not limited to this particular form, and may also be provided in other types of electrically-controlled valves as well.

Before proceeding, it is deemed advisable to first review the fundamental structure and operation of several prior art types of servovalves, in order that the improvement may be better appreciated in context.

Figure 1A:
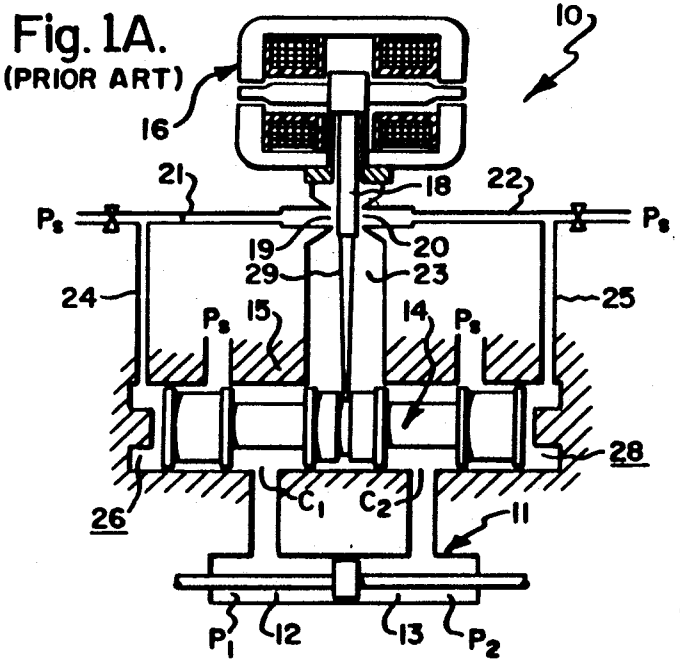
Fig. 1A. (PRIOR ART)
FIG. 1A is a structural schematic of a conventional two-stage "flow-control" electrohydraulic servovalve.
Figure 1B:
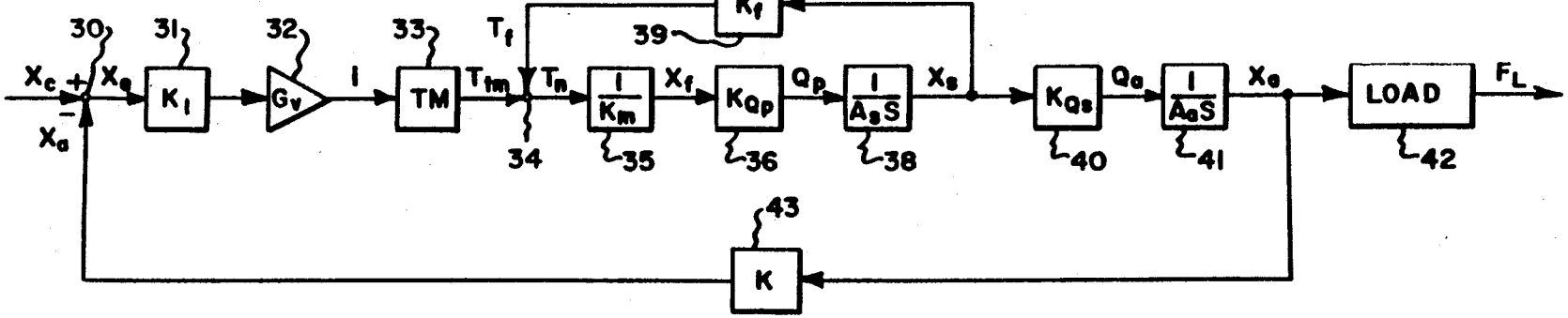
Fig. 1B. (PRIOR ART)
FIG. 1B is a typical block diagram of the "flow-control" servovalve shown in FIG. 1A.

Prior Art "Flow-Control" Servovalve (FIGS. 1A–1C)

FIG. 1A schematically depicts the structure of a conventional two-stage "flow-control" electrohydraulic servovalve, generally indicated at 10, in operative association with a fluid-powdered actuator, generally indicated at 11, having opposed piston faces of equal area facing into the actuator left and right chambers 12,13. FIG. 1B depicts a representative block diagram of the servoactuator shown in FIG. 1A, and FIG. 1C shows the pressure-flow characteristics of such a "flow-control" servovalve.

Referring now to FIG. 1A, servovalve 10 is of the type more fully shown and described in U.S. Pat. No. 3,023,782, the aggregate disclosure of which is hereby incorporated by reference. This servovalve has a first- or pilot-stage operatively arranged to selectively displace a second-stage valve spool 14 relative to a body 15. The first-stage includes a torque motor 16 operatively arranged to produce substantially-frictionless pivotal movement of a flapper 18 (i.e., in the plane of the paper) in response to a supplied electrical current. The polarity of such supplied current determines the direction (i.e., either clockwise or counterclockwise) of such pivotal movement, and the magnitude of such current determines the magnitude of such pivotal movement in the appropriate direction. The flapper has a portion arranged between two opposed left and right nozzles 19,20. Pressurized fluid at supply pressure $P_s$ is continually provided to the ends of passageways 21,22 which communicate with nozzles 19,20, respectively. Each passageway contains a restrictive orifice. Hence, fluid is continuously discharged through both nozzles into a common chamber 23, which communicates with a fluid return or sump at a return pressure R. Branch passages 24,25 communicate passageways 21,22 intermediate their restricted orifices and nozzles, with left and right spool end chambers 26,28, respectively. A mechanical feedback spring wire 29 acts between the spool and flapper.

Spool 14 is shown as having three axially-spaced lobes mounted on a common stem, with each lobe being zero-lapped with respect to an associated body slot or port when the spool is in a null position, as shown in FIG. 1A. Thus, in such null position, the left and right spool lobes just cover left and right body slots, respectively, communicating with a source (not shown) of pressurized fluid at supply pressure $P_s$, while the middle lobe just covers a return slot at the return pressure R. The annular chamber between the left and middle lobes communicates via control port $C_1$ with actuator left chamber 12, and the annular chamber between the middle and right lobes communicates via control port $C_2$ with actuator right chamber 13. Hence, servovalve 10 is a four-way valve, with operative connections to $P_s$, R, $C_1$ and $C_2$.

When no current is supplied to the torque motor, certain centering springs (now shown) therein urge flapper toward a centered position between nozzles 19,20. However, the flapper is connected to the spool by spring wire 18. Hence, if the spool is off-null when the current is zero, the spring wire will prevent the flapper from moving to such centered position. Hence, a pressure differential will be created between the spool end chambers, which differential urges the spool to move back toward the null position. Ultimately, when the spool has moved to such null position, there will be no flow through the second-stage with respect to control ports $C_1$, $C_2$.

Assume now that a current of appropriate magnitude and polarity is supplied to the torque motor to cause the flapper to pivot in a clockwise direction. This will cause the flapper to move closer to left nozzle 19, thereby increasing the back pressure in left spool end chamber 26, and farther from right nozzle 20, thereby decreasing the back pressure in right spool end chamber 28. The differential pilot pressure thus created between chambers 26,28 exerts a net force on the spool, which causes it to move rightwardly off null relative to the body. Such rightward spool displacement will continue until feedback spring wire 29 pulls the initially-displaced flapper back to a centered position between the two nozzles, where the differential pilot pressure is just sufficient to bend the spring wire to balance the torque developed by the motor. Hence, rightward spool displacement will be substantially proportional to the magnitude of the supplied current. Such rightward displacement of the spool relative to the body allows fluid to flow from the source through control port $C_2$ to actuator right chamber 13, and from actuator left chamber 12 through control port $C_1$ to return.

Alternatively, if a current of opposite polarity is supplied to the torque motor, the flapper will pivot in a counterclockwise direction so as to be arranged closer to right nozzle 20 and farther from left nozzle 19. This will create an opposite pilot pressure differential between spool end chambers 26,28, to displace the spool leftwardly off null. Such leftward displacement of the spool relative to the body will continue until spring wire 29 pulls the flapper back to a centered position between the two nozzles, where the differential pressure in the spool end chambers is just sufficient to bend the spring wire to balance the torque developed by the motor. The amount of such leftward displacement will be proportional to the magnitude of the supplied current, the direction of movement being indicated by the polarity of such current. However, in this case, fluid may flow from the source through control port $C_1$ to actuator left chamber 12, and from actuator right chamber 13 through control port $C_2$ to return.

In the absence of a supplied current (i.e., i=0), the centering springs (not shown) in the torque motor will allow the feedback spring wire to deflect the flapper so as to cause the spool to move toward the null position until such feedback spring force is reduced to zero. When the spool has returned to the null position, as shown, further flow through the second-stage is blocked.

This type of valve is called a "flow-control" servovalve because, for a constant external load acting on the actuator, flow through the valve will be substantially proportional to the supplied current. See, e.g., Technical Bulletin 103, "Transfer Functions for Moog Servovalves", supra [at pp. 3–4]. As indicated above, the term "flow-control", while now widely adopted to refer to this type of valve, is somewhat inapt since flow will be proportional to current only at constant load. If the pressure differential across the second-stage orifices varies, so will the flow. Nevertheless, in this type of valve, the magnitude of spool displacement off null is substantially proportional to the magnitude of the supplied current, at constant load.

FIG. 1B is a typical block diagram of the "flow-control" servovalve and actuator shown in FIG. 1A. A command signal $X_c$, representing the desired position of the actuator rod relative to its cylinder, is supplied as a positive input to a summing point 30, which also receives a negative feedback signal $X_a$ reflective of the actual actuator position. These two signals are algebraically summed to produce an actuator position error signal $X_e$. This signal, when multiplied by an appropriate gain $K_1$, indicated in block 31, is supplied to a servoamplifier 32 to provide a current i of appropriate magnitude and polarity. That current is then supplied to the torque motor, represented by block 33, which exerts a torque $T_{tm}$ on the flapper and urges it to move pivotally between the nozzles. That torque is supplied to a summing point 34, which also receives the opposing torque $T_f$ exerted by the spring wire as a negative feedback signal. Torques $T_{tm}$ and $T_f$ are algebraically summed to produce a net torque $T_n$, which, when divided by the stiffness of the flapper, represented by a gain of $1/K_m$ in block 35, produces a flapper displacement $x_f$ between the nozzles. This flapper displacement, when multiplied by the pilot-stage flow gain $K_{QP}$ in block 36, produces a pilot-stage flow $Q_P$ to the spool end chambers. The pilot-stage flow acts on the spool end face (which is of area $A_s$) to produce a spool velocity, which integrates naturally (as indicated by the function 1/S) to produce spool position $x_s$. Hence, pilot flow $Q_P$ when multiplied by a gain of $1/A_sS$ in block 38, produces spool position $x_s$. This spool position is supplied via a spool position feedback loop containing a gain $K_f$ in block 39, representing the stiffness of the spring wire, to summing point 34 as signal $T_f$. The spool position $x_s$ is multiplied by the spool flow gain, represented by $K_{QS}$ in block 40, to produce a flow $Q_a$ to the actuator. This flow acts against the face of the actuator piston (of area $A_a$) and integrates naturally to produce actuator position $X_a$. Hence, signal $Q_a$ is multiplied by a gain of $1/A_aS$ in block 41, to produce actuator position $X_a$. The actuator position is coupled to the load, indicated in block 42. A position servoloop, containing an appropriate gain K in block 43, is typically closed about the actuator and servovalve, and supplies the actual actuator position signal $X_a$ back to summing point 30. This outer servoloop operates the valve so as to drive the actuator position error $X_e$ toward zero.

FIG. 1C illustrates the typical pressure-flow characteristics of such a "flow-control" servovalve. The ordinate expresses flow as a fraction of flow at zero-load, while the abscissa expresses differential load pressure (i.e., $P_1-P_2$) as a percentage of supply pressure. Assuming the presence of sharp-edged orifices, the general equation for flow (Q) of an incompressible fluid through such a "four-way" "flow-control" valve is:

$$Q=CA(P_s-\Delta P_L)^{\frac{1}{2}} \quad (1)$$

where C is a constant, A is the area of the orifice or port created when the spool is moved off null, $P_s$ is the supply pressure, and $\Delta P_L$ is the load pressure differential (i.e., $P_1-P_2$). In FIG. 1C, the orifice area A is expressed in terms of its analog valve current (i), and is expressed as a fraction of its maximum value. Thus, FIG. 1C depicts a first family of parabolic curves issuing from $\Delta P_L=+1$ into the first and second quadrants, and a second family of such curves issuing from $\Delta P_L=-1$ into the third and fourth quadrants. These two families of curves are identical in shape. The first family indicates that the supplied current is positive, and the second indicates that such current in negative. The polarity of the load pressure differential indicates the direction of the applied load, and the polarity of the flow indicates the direction of such flow. Hence, in the first and third quadrants, the load opposes the desired direction of actuator movement, and in the second and fourth, the load aids such movement. Since the opposing faces of the actuator piston are of equal area, the flow into one actuator chamber will substantially equal the flow from the other.

As noted previously, at small currents near the abscissa (i.e., x-axis), the pressure gain of such a "flow-control" valve is comparatively high. This is highly advantageous when used to break-out from a static position. However, this characteristic makes difficult the use of two "flow-control" servovalves in a redundant-type application because a mismatch in the pressure gains of the two valves leads to force-fighting therebetween at the load.

Figure 2C:
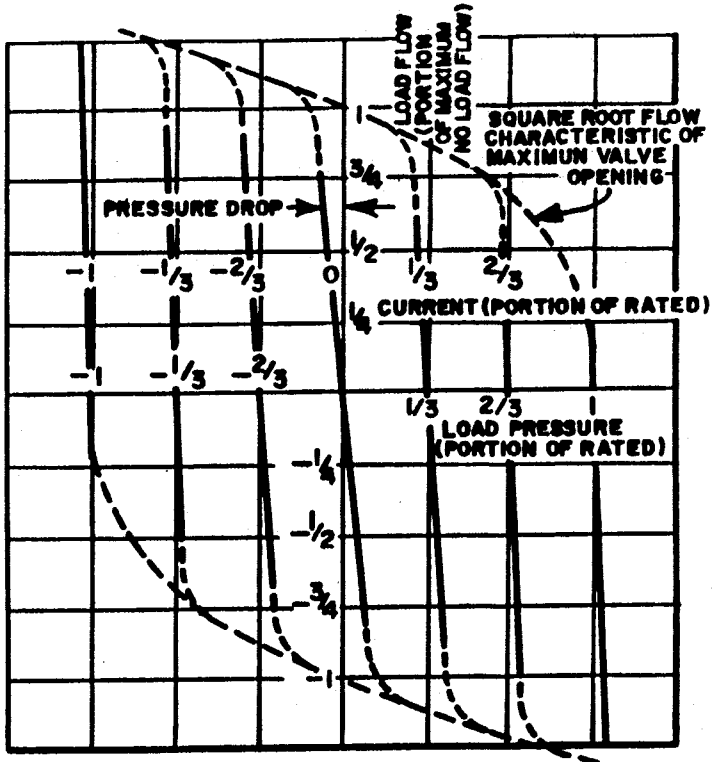
Fig.2C. (PRIOR ART)
FIG. 2C is a plot of the pressure-flow characteristics of the "pressure-control" servovalve shown in FIG. 2A.
Figure 2B:
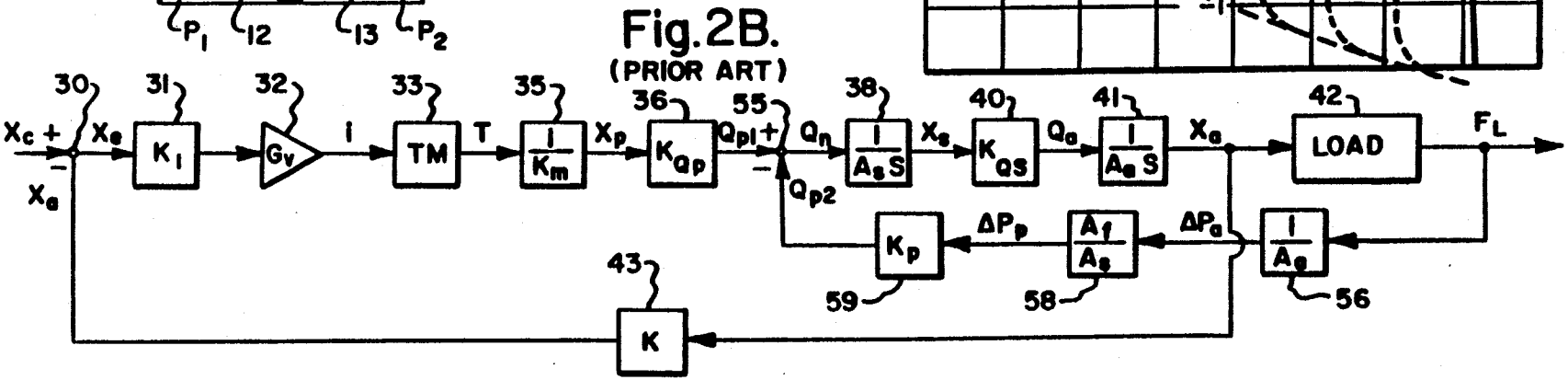
Fig.2B. (PRIOR ART)
FIG. 2B is a typical block diagram of the "pressure-control" servovalve shown in FIG. 2A.
Figure 2A:
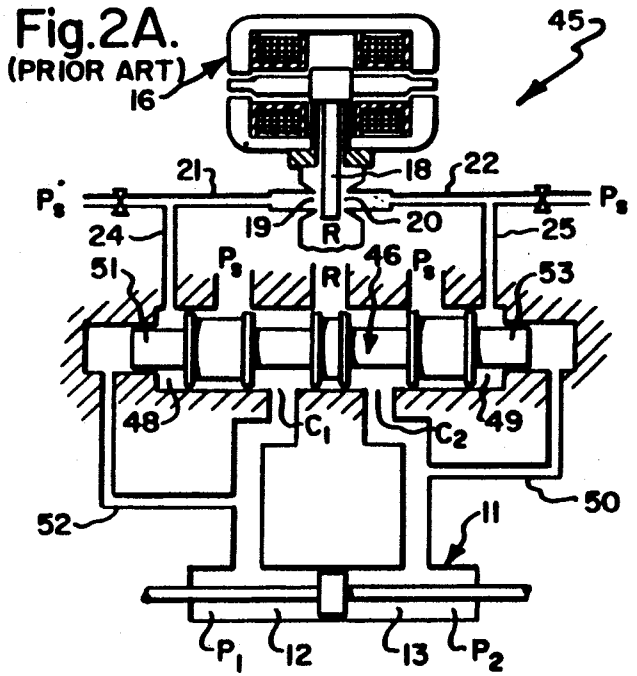
Fig.2A. (PRIOR ART)
FIG. 2A is a structural schematic of a conventional two-stage "pressure-control" electrohydraulic servovalve.

Prior Art "Pressure-Control" Servovalve (FIGS. 2A–2C)

FIG. 2A schematically illustrates the structure of a conventional two-stage "pressure-control" servovalve, generally indicated at 45, operatively associated with actuator 11. FIG. 2B illustrates a typical block diagram of the servoactuator in FIG. 2A, and FIG. 2C depicts the pressure-flow characteristics of such servovalve.

Referring now to FIG. 2A, servovalve 45 is generally of the type disclosed in U.S. Pat. No. 2,931,389, the aggregate disclosure of which is hereby incorporated by reference. This type of servovalve has a first- or pilot-stage similar to that previously described. Hence, the same reference numerals have been used to again refer to such previously-described structure, and the following description can be somewhat abbreviated and focused on the differences between the "flow-control" and "pressure-control" servovalves.

While the first-stage is again of the nozzle-flapper type, it should be noted that mechanical feedback spring wire 29 has been deliberately eliminated. Moreover, the second-stage spool, together with its operative connections to the load, differs from that previously described. Spool 46 again has three axially-spaced zero-lapped lobes. However, when the spool is at null, as shown in FIG. 2A, the left and right spool lobes just cover and close body slots communicating with the pressure supply $P_s$, and the spool middle lobe just covers a common fluid return slot. Moreover, a stub shaft extends axially outwardly from each end of the spool. The pressures in passageways 21,22 are supplied via branch passages 24,25 to annular spool end chambers 48,49, respectively, surrounding the respective stub shafts. Pressure $P_1$ in actuator left chamber 12 is supplied by a passage 52 to act on the end face of left stub shaft 51. Conversely, the pressure $P_2$ in actuator right chamber 13 is supplied by a passage 50 to act on an end face of right stub shaft 53. Because feedback spring wire 29 has been omitted, the spool and flapper are mechanically uncoupled. Hence, the spool may move to any position determined by the various fluid forces acting thereon, as described infra. The annular surfaces of the spool facing into chambers 48,49 are both of area $A_s$ while the circular end faces of the stub shafts are both of area $A_f$.

Hence, an electrical current of desired polarity and magnitude may be supplied to the torque motor to pivotally displace the flapper 18 between nozzles 19,20. The position of the flapper relative to these nozzles is again employed to develop back pressures in passageways 21,22, which are supplied via branch passageways, 24,25 to spool end chambers 48,49, respectively. The differential of these back pressures acts against area $A_s$ to exert a first force on the spool which urges it to move off null in the appropriate direction. However, the load pressures $P_1$,$P_2$ are supplied via passages 52,50, respectively, to act on the opposing end faces of the stub shafts. Hence, the pressure differential supplied by the pilot stage exerts a first force on the spool, and the load pressure differential exerts a second opposing force on the spool. Thus, the differential load pressure (i.e., $P_1-P_2$) will vary directly with the differential pilot pressure in annular chambers 48,49 through a constant gain equal to the ratio of the spool areas facing into chambers 48,49 to the area of the stub shaft end faces (i.e., $A_s/A_f$). Hence, this type of valve is called a "pressure-control" servovalve because the load pressure differential is proportional to the supplied current.

When the supplied current is zero, the commanded load pressure is zero. In this situation, centering springs (not shown) in the torque motor move the flapper back to a centered position between the two nozzles. Hence, equal back pressures are supplied by the pilot-stage to spool end chambers 48,49. These pressures exert equal and opposing forces on the spool which effectively cancel one another. If the load pressure differential attempts to rise above zero, as by an external load being applied to the actuator, such differential pressure will act on the area of the stub shaft end face to displace the spool in the appropriate direction to relieve such load pressure differential.

On the other hand, suppose that an appropriate current is now supplied to the torque motor. The polarity of that current will indicate the polarity of the desired output pressure differential (i.e., $P_1>P_2$, or $_1<P_2$), and the magnitude of that current will indicate the magnitude of the desired differential. Such supplied current will cause an appropriate proportional pivotal movement of the flapper relative to the nozzles, and the pressure differential created in spool end chambers 48,49 will displace the spool off null in the appropriate direction to authorize such commanded differential. If the actual load pressure differential is less than that commanded, the spool will move farther off null in an attempt to increase the load pressure differential to that commanded. On the other hand, if the load pressure differential is greater than that commanded, the spool will be urged back toward null in an attempt to reduce the actual differential. Thus, in such a "pressure-control" valve, the load pressure differential is substantially proportional to the supplied current, but flow through the second-stage is not controlled.

FIG. 2B illustrates a typical block diagram of the servoactuator shown in FIG. 2A. From a macroscopic view point, the block diagram for the "pressure-control" servovalve differs from that of the "flow-control" servovalve in that the spool position feedback loop has been deliberately omitted, and a pressure feedback loop has been added. Since many of the feedforward elements are the same, the same reference numerals have again been used to indicate corresponding summing points or blocks. Thus, a command signal $X_c$, again representing the desired position of the actuator rod relative to the cylinder, is supplied as a positive input to summing point 30, which also receives a negative feedback signal $X_a$ reflective of the actual actuator position. These two signals are algebraically summed to produce an actuator position error signal $X_e$ which is supplied to servoamplifier 32 via an intermediate gain block 31. The servoamplifier then supplies a current i proportional to the position error signal to torque motor 33, which, in turn, exerts a torque T on the flapper. Summing point 34 has been eliminated, and such torque, when divided by the stiffness of the flapper, again represented by a gain of $1/K_m$ in block 35, produces a flapper displacement $x_p$ between the nozzles. This flapper displacement is then multiplied by the flow gain of the pilot stage, presented by a gain of $K_{QP}$ in block 36, to produce a pilot flow $Q_{P1}$ to spool end chambers 48,49. This pilot flow is supplied as a positive input to summing point 55, which also receives a flow $Q_{P2}$ as a negative feedback signal from the pressure feedback loop. These two mathematical flows are algebraically summed in summing point 55, and the difference therebetween supplied as a net flow $Q_n$. This net flow, when divided by the area of the spool end chamber, naturally integrates to produce a spool position. Hence, the net flow $Q_n$ is multiplied by a gain of $1/A_sS$ in block 38 to produce spool position $x_s$. This signal, when multiplied by the flow gain of the spool, represented by a gain of $K_{QS}$ in block 40, produces a flow $Q_a$ to the actuator. This flow acts against an area of the actuator to produce a velocity, and integrates naturally to produce a position. Hence, $Q_a$ is multiplied by a gain of $1/A_aS$ in block 41 to produce actuator position $X_a$. This signal acts on the load, indicated by block 42. At the same time, the actuator position is supplied via gain block 43 as the negative feedback signal to summing point 30. A pressure feedback loop is closed about the load and the spool. The force $F_L$ exerted on the load, when divided by the effective area of the actuator piston, represented by a gain of $1/A_a$ in block 56, produces the differential actuator pressure $P_1-P_2$. This differential pressure, is then multiplied by the ratio of the area of the spool stub shaft to that of the spool end chamber, this being represented by a gain of $A_f/a_s$ in block 58, to produce an equivalent differential pilot pressure $\Delta P_p$. This, when multiplied by gain $K_p$ in block 59, produces an equivalent pilot flow $Q_{P2}$, which is supplied to summing point 55.

Thus, in such a "pressure-control" valve, there is typically no mechanical feedback loop closed about the spool and driver. Rather, the spool is free to move to any position commanded by the various fluid forces acting thereon. However, a pressure feedback loop is closed about the load and the spool, for exerting a force on the spool which opposes the force attributable to the pilot pressure differential produced by the commanded flapper displacement. Hence, the differential load pressure is substantially proportional to the current supplied to the torque motor. However, flow through the valve is not controlled.

FIG. 2C is a plot of the representative pressure-flow characteristics of the "pressure-control" servovalve shown in FIG. 2A. The ordinate again expresses flow as a fraction of maximum flow at zero-load, and is either positive or negative depending upon the direction of such flow. The abscissa again expresses differential load pressure (i.e., $P_1-P_2$) as a fraction of supply pressure (i.e., $P_s$), and is also either positive or negative depending upon the polarity of such load pressure. The dashed lines represent the maximum possible flow through the valve at maximum valve opening (i.e., $i=i_{max}$), and are calculated from equation (1). These dashed line curves represent the outer limits of the ability of the servovalve to respond. FIG. 2C illustrates a family of horizontally-spaced substantially-vertical curves, the upper and lower margins of which appear to a symptomatically approach the maximum flow characteristics of the valve. The various curves of this family represent different positive and negative currents (expressed as a percentage of maximum current) supplied to the torque motor. Thus, these curves simply illustrate that load pressure differential is substantially proportional to supplied current and relatively independent of flow.

Figure 3C:
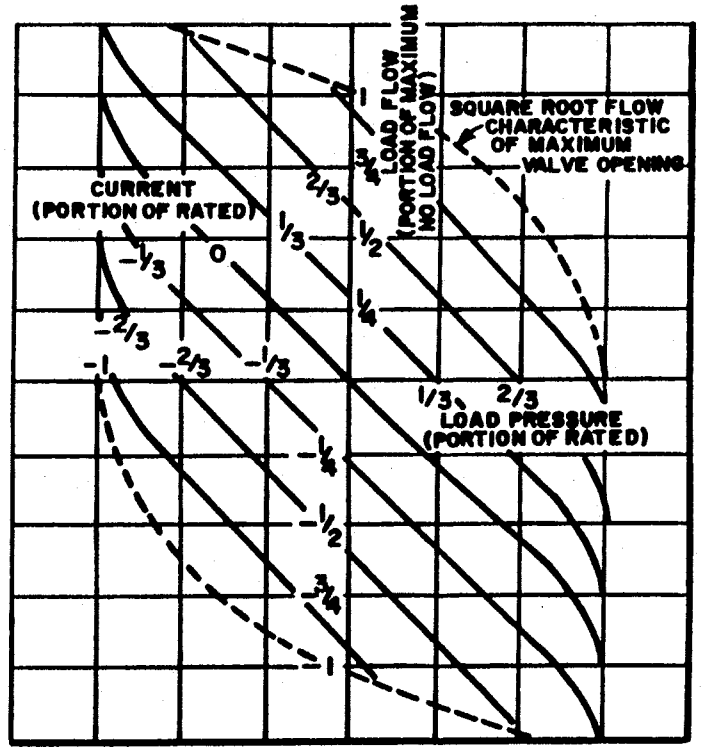
Fig. 3C. (PRIOR ART)
FIG. 3C is a plot of the pressure-flow characteristics of the "pressure-flow" servovalve shown in FIG. 3A.
Figure 3B:
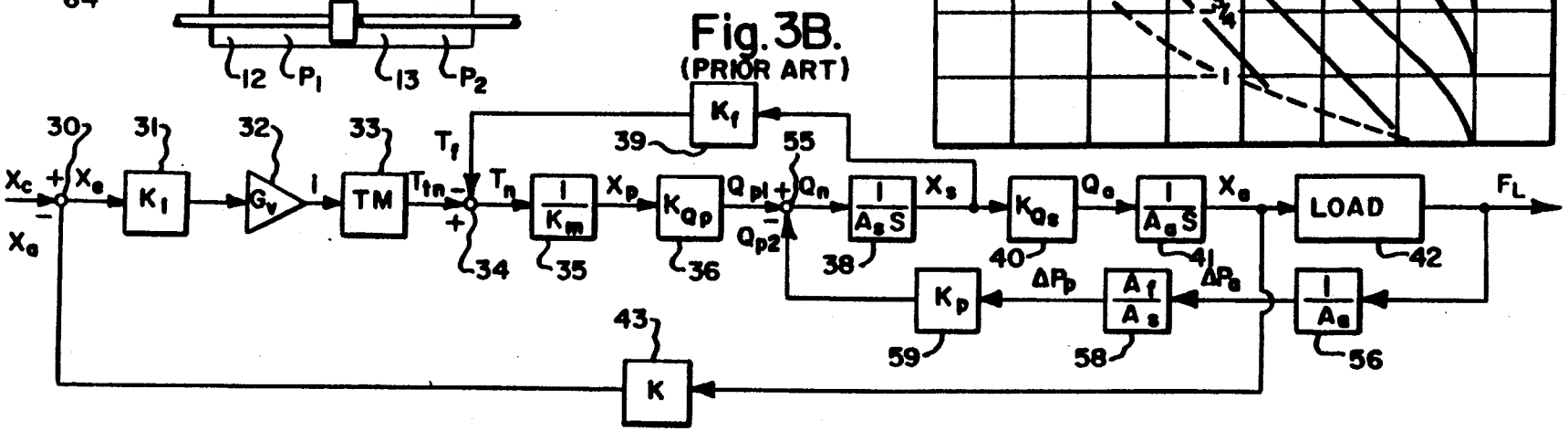
Fig. 3B. (PRIOR ART)
FIG. 3B is a typical block diagram of the "pressure-flow" servovalve shown in FIG. 3A.
Figure 3A:
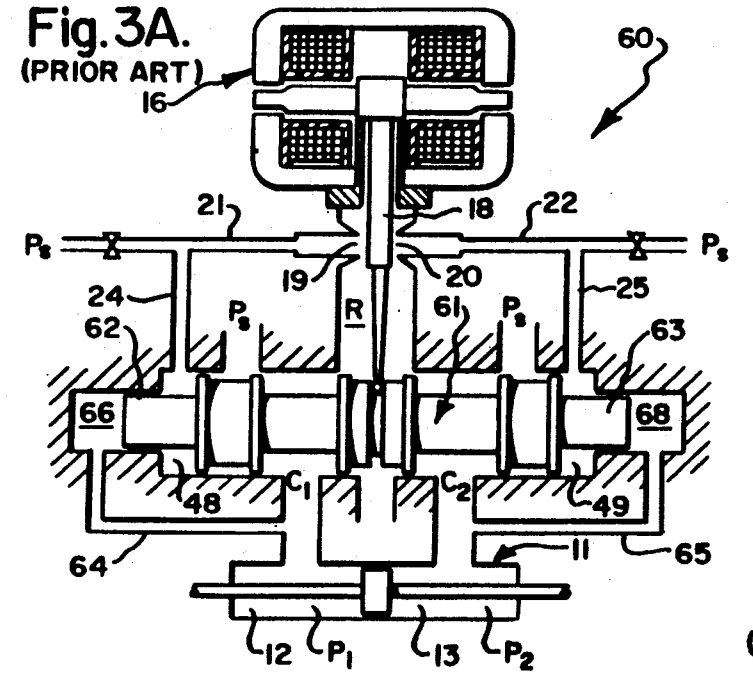
Fig. 3A. (PRIOR ART)
FIG. 3A is a structural schematic of a conventional two-stage "pressure-flow" electrohydraulic servovalve.

Prior Art "Pressure-Flow" Servovalve (FIGS. 3A-3C)

FIG. 3A schematically depicts the fundamental structure of a known "pressure-flow" servovalve, generally indicated at 60, again in operative association with actuator 11. This type of valve is commonly referred to as a "PQ" valve, and is more fully shown and described in U.S. Pat. No. 2,964,059, in Technical Bulletin 103, "Transfer Functions of Moog Servovalves", Moog Inc. (1965) and in Technical Bulletin 101, "Controlled Damping Through Dynamic Pressure Feedback", Moog Inc. (1972), the aggregate disclosures of which are hereby incorporated by reference. FIG. 3B depicts a typical block diagram of a servoactuator employing such a "PQ" valve, and FIG. 3C is a plot of the representative pressure-flow characteristics of same.

A "PQ" servovalve typically has interwined mechanical spool position and pressure feedback loops. More particularly, the spool position loop is closed about the spool and pilot stage, while the pressure loop is closed about the load and spool. Hence, such a "PQ" valve typically has the mechanical spool position feedback loop of a conventional "flow-control" servovalve, and the pressure feedback loop of a conventional "pressure-control" servovalve. Such "PQ" valves as have been developed heretofore, have been deliberately designed to have pressure-flow characteristics, illustrated infra, between those of a pure "flow-control" valve and those of a pure "pressure-control" valve. The reason for this is that, if destined for use in a redundant servosystem where two or more valves are employed to move a common load, it is imperative to reduce the high pressure gain of "flow-control" servovalves at low currents, so as to reduce force-fighting. Thus, the PQ servovalve was developed to reduce such high pressure gain characteristics of the "flow-control" valve.

Referring now to FIG. 3A, "PQ" servovalve 60 is shown as again including torque motor 16 having its flapper 18 operatively arranged for pivotal movement between opposed nozzles 19,20 in response to the polarity and magnitude of the supplied electrical current. Passageways 21, 22 continuously supply pressurized fluid from a suitable source (not shown) to left and right nozzles 19,20. Fluid is discharged through these nozzles into a common chamber 23 at return pressure R. Here again, the position of the flapper relative to the two nozzles is used to control the back pressures in passageways 21, 22, which communicate with annular spool end chambers 48,49 via branch passages 24,25, respectively. Spool 61 is similar to the spool of the "pressure-control" servovalve, previously described, in that it has three axially-spaced zero-lapped lobes with stub shafts 62,63 issuing axially outwardly from either end. When the spool is in its null position, as shown in FIG. 3A, the left and right lobes just cover and close left and right supply ports communicating with a suitable source (not shown) of fluid at supply pressure $P_s$, and the middle lobe just covers and closes a common return port at return pressure R. A spring wire 29 operatively connects the flapper and spool to close a mechanical spool position feedback loop about the spool and driver. Branch passages 64,65 communicate the load pressures $P_1,P_2$ in actuator chambers 12,13 with the stub shaft end chambers 66,68.

Thus, in the absence of a supplied current (i.e., $i=0$), the torque motor centering springs (not shown) will urge the flapper to move toward a centered position between the two nozzles, at which the differential pressure in the spool end chambers is just sufficient to bend the feedback spring wire so as to balance the motor-produced torque. If the load pressure differential ($P_1-P_2$) is also zero, the spool will be in its null position relative to the body (as shown), and there will be no flow through the valve.

If now a load is applied to the actuator such that $P_1>P_2$, a load pressure differential (i.e., $P_1-P_2$) will exert a net rightward force on the spool in an attempt to relieve the differential, since the existence of a differential varies from the zero differential electrically commanded. However, such rightward movement of the spool also pulls the flapper closer to right nozzle 20 and farther from left nozzle 19. Hence, the pressure differential created by the pilot stage acts on the annular spool end face to exert an opposing leftward force on the spool. Hence, the spool will move rightwardly to a position at which these two fluid forces balance one another.

Conversely, if an electrical current of desired polarity and magnitude is supplied to the torque motor when the spool is at null, the flapper will move to an electrically-commanded position between the nozzles. This will create a pressure differential in spool end chambers 48,49, which will drive the spool in the appropriate direction. However, as the load pressure differential ($P_1-P_2$) begins to increase, this differential, acting across the area of the stub shafts, will exert an opposing force on the spool. Moreover, the feedback spring wire 29 will tend to pull the flapper back toward a centered position between the nozzles.

FIG. 3B is a typical block diagram of the servoactuator shown in FIG. 3A. Here again, since the various blocks and gains of the structure shown in FIG. 3B have been previously described, the same reference numerals will be used, where applicable, to previously-described structure. A position command signal $X_c$ is supplied as a positive input to summing point 30, which also receives a signal $X_a$, reflective of the actual actuator position, as a negative feedback signal. These two signals are algebraically summed, and the difference therebetween is supplied as an actuator position error signal $X_e$ to servoamplifier 32 via an intermediate gain block 31. The servoamplifier produces a current i proportional to the position error $X_e$. Such current causes the torque motor 33 to exert a torque $T_{tm}$, which is supplied as a positive input to summing point 34. This summing point also receives a torque $T_f$ due to the effect of the feedback spring wire as a negative input. These two torques are algebraically summed to produce a net torque $T_n$. This signal is then multiplied by the stiffness of the flapper, represented by a gain of $1/K_m$ in block 35, to provide the flapper position $x_p$. The flapper position is then multiplied by the pilot-stage flow gain, this being indicated by a gain $K_{QP}$ in block 36, to provide a first pilot flow $Q_{P1}$, which is supplied as a positive input to summing point 55. This summing point also receives an opposing flow $Q_{P2}$ from the pressure feedback loop. These two mathematical flows are algebraically summed to provide a net flow $Q_n$ on the spool. This flow is represented as acting against the spool end chamber to provide a velocity, which integrates naturally to produce a spool position $x_s$. Hence, the gain in block 38 is represented as being $1/A_sS$. The spool position is multiplied by the feedback wire stiffness, represented by a gain of $K_f$ in block 39, to provide the feedback torque signal $T_f$ to summing point 35. The spool position signal $x_s$ is then multiplied by the second-stage flow gain, represented by a gain of $K_{QS}$ in block 40, to produce a net flow $Q_a$ to the actuator. This flow can be divided by the area of the actuator against which it acts, to produce spool velocity, which integrates naturally to produce spool position. Hence, flow $Q_a$, when multiplied by a gain of $1/A_aS$ in block 41, produces actuator position $X_a$. This is supplied to the load, represented by block 42, which produces a force thereon. This force when divided by the area of the actuator $A_a$, shown in block 56, produces a signal $P_1-P_2$ representing the load pressure differential. This differential when multiplied by the ratio of the area of the stub shaft to the annular spool end face, represented by $A_f/A_s$ in block 58, produces an equivalent change in the pilot pressure. This change when multiplied by a gain of $K_p$ in block 59 provides flow an equivalent $Q_{P2}$, which is supplied to summing point 55. The actuator position signal $X_a$ is supplied as a negative feedback to summing point 30 via an intermediate gain K in block 43.

FIG. 3C is a plot of the typical pressure-flow characteristics of such a "PQ" servovalve. The ordinate again expressed flow as a fraction of maximum flow at zero-load, and is either positive or negative depending upon the direction of such flow. Similarly, the abscissa depicts the load pressure differential as a fraction of the supply pressure, and is also either positive or negative depending upon the polarity of such differential. The dashed line curves represent the maximum flow through the valve at maximum valve opening (i.e., $i=i_{max}$), and expresses a limitation on the capacity of the valve to respond. FIG. 3C depicts a family of substantially-linear inclined parallel curves. The several curves of this family are individually identified by the amount of current supplied to the valve, expressed as a fraction of maximum current.

Thus, FIG. 3C visually depicts that the pressure-flow characteristics of such prior art "PQ" valves have been between those of a conventional "flow-control" servovalve (i.e., FIG. 1B) and a conventional "pressure-control" servovalve (i.e., FIG. 2B).

Improved Servovalve (FIGS. 4A–4D)

The present invention provides an improved electrically-controlled servovalve having intertwined spool position and pressure feedback loops, as in the case of a "PQ" valve, but nevertheless having deliberate and intended pressure-flow characteristics approximating those of a conventional "flow-control" valve. Otherwise stated, the invention provides an improved servovalve which outwardly behaves as though it were a conventional "flow-control" servovalve, but which nevertheless affords access to an electrical signal which is proportional to the load pressure differential (i.e., $P_1-P_2$).

Figure 4C:
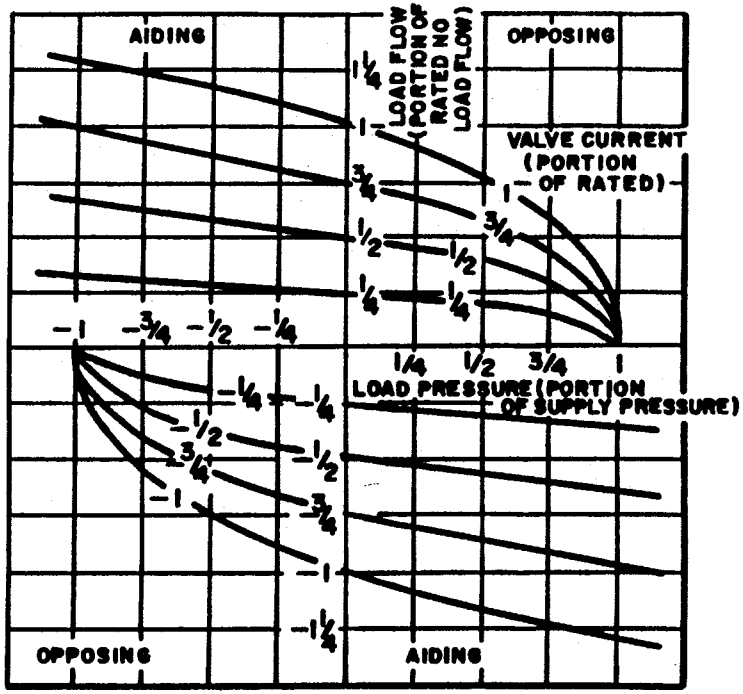
FIG. 4C is a plot of the pressure-flow characteristics of the improved servovalve shown in FIG. 4A.
Figure 4A:
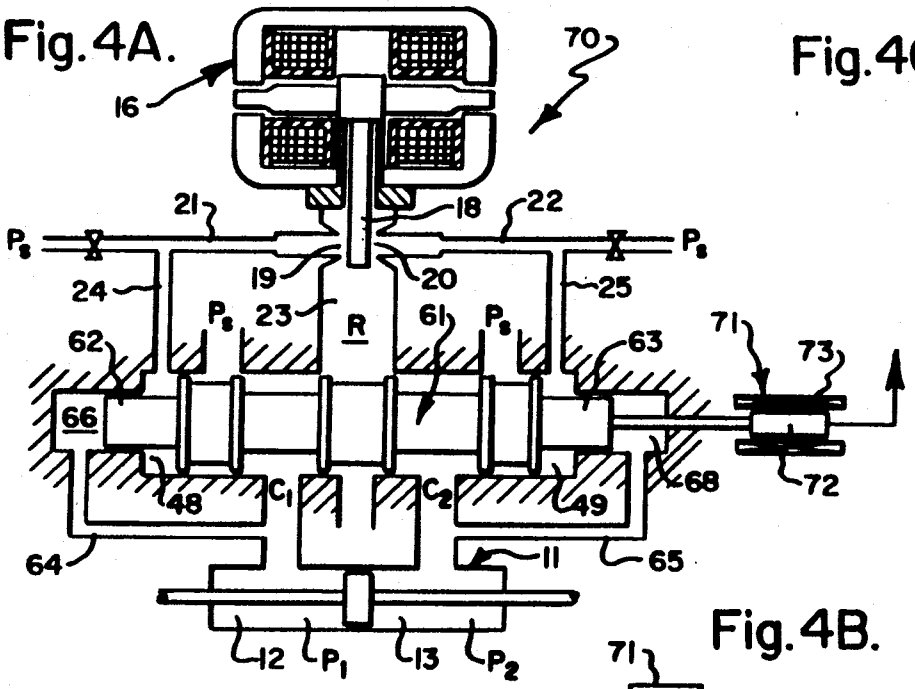
FIG. 4A is a structural schematic of an improved two-stage electrohydraulic servovalve having pressure-flow characteristics approximating those of a conventional "flow-control" servovalve, but affording access to an electrical signal substantially proportional to the load pressure differential.

Referring now to FIG. 4A, the physical structure of the improved valve, generally indicated at 70, closely resembles that of the "PQ" valve, except that the mechanical feedback spring wire 29 has been eliminated. The other elements of the improved structure are substantially the same as those of the "PQ" valve shown in FIG. 3A. Hence, the same reference numerals have been again used to refer to the previously-described structure. In the improved valve, however, the position of the spool relative to the body is continuously monitored by a suitable electrical transducer, such as an LVDT 71. This device has a core 72 mounted on the spool for movement therewith relative to an encircling coil 73 mounted on the body. Hence, the LVDT is arranged to supply an electrical signal reflective of the position of the spool relative to the body. The use of that signal will be discussed with respect to FIG. 4B.

Figure 4B:
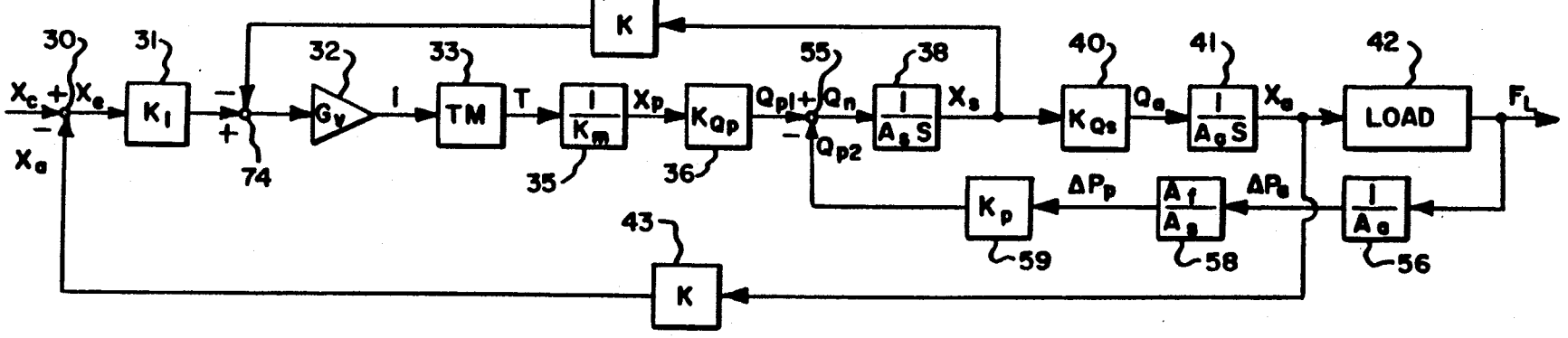
FIG. 4B is a typical block diagram of the improved servovalve shown in FIG. 4A.

FIG. 4B is a block diagram of the servoactuator shown in FIG. 4A. This diagram is similar to that shown in FIG. 3B in that the spool position and pressure feedback loops are again intertwined. However, in the improved valve, the mechanical spool position feedback loop used in the prior art "PQ" valve has been replaced by an electrical feedback loop, which has been extended to further encompass the servoamplifier. In other words, in the prior art "PQ" valve, spool position $x_s$ was converted by the stiffness of the feedback spring wire, this having been represented by gain $K_f$ in block 39, to produce a torque attributable to spool position. This torque opposed the electrically-commanded torque produced by the torque motor. Hence, the output of summing point 39 represented the net torque exerted on the flapper. This net torque caused a change in flapper position, and hence a net pilot flow $Q_{P1}$ to the spool end chambers. As a consequence, the known "PQ" valve did not contain in its block diagram an electrical signal proportional to the load pressure differential. Rather, the net torque and flapper position were proportional to the load pressure differential, but the values of these parameters were not measured. Indeed, these parameters would be difficult to measure, in the context of the physical structure, even if one so desired. In the improved servovalve, the electrical spool position feedback loop is supplied to a summing point ahead of the servoamplifier. Hence, the current supplied to the torque motor will be proportional to the load pressure differential, as in the case of a pure "pressure-control" valve.

Thus, in FIG. 4B, an actuator position command signal $X_c$ is again supplied as a positive input to summing point 30, which also receives an actuator actual position signal $X_a$ as a negative feedback signal. These two signals are algebraically summed to provide an actuator position error signal $X_e$. In the improved valve, the gain K in block 31 is sufficiently high that the gain of the position feedback loop dominates that of the pressure feedback loop. This causes the improved valve to have the pressure-flow characteristics approximating those of a conventional "flow-control" servovalve. Position error $X_e$ is multiplied by gain K in block 31, and the product therebetween is supplied as a positive input to summing point 74. This summing point also receives an negative electrical feedback signal reflective of the actual spool position. The algebraic sum of these two signals is then supplied to the servoamplifier 32, which provides a proportional electrical current i to torque motor 33. This current in turn causes a proportional torque T to act on the flapper. This torque is then multiplied by a gain of $1/K_m$ in block 35, this representing the stiffness of the flapper, to produce a flapper position $x_f$ between the nozzles. Such flapper position produces a differential pressure and pilot flow to the spool end chambers. Hence, flapper position $x_f$, when multiplied by the pilot-stage flow gain $K_{QP}$ in block 36, produces a first flow $Q_{P1}$, which is supplied as a positive input to summing point 55. This summing point also receives a second flow $Q_{P2}$ from the pressure loop as a negative input. Hence, flows $Q_{P1}$ and $Q_{P2}$ are summed to provide a net flow $A_N$ to the spool. This net flow, when divided by the area of the actuator piston against which it acts, produces a piston velocity, which integrates naturally to spool position $x_s$. Hence, the net flow $Q_n$ is multiplied by a gain of $1/A_sS$ in block 38, to provide spool position $x_s$. this spool position is determined by LVDT 71, and is provided as the analog negative position signal to summing point 74. The spool position, when multiplied by the flow gain, represented by $K_{QS}$ in block 40, produces a flow $Q_a$ with respect to the actuator. This flow can be divided by the area of the actuator piston $A_a$ against which its acts, to produce an actuator velocity, which integrates naturally to actuator position $X_a$. Hence, $Q_a$ is multiplied by a gain of $1/A_aS$ in block 31, to produce actuator position $X_a$. The actuator position acts on the load, represented by block 42, to produce a force on the load $F_L$.

The force on the load is supplied as the input to the pressure feedback loop. This force may be divided by the actuator piston area $A_a$ to produce the differential load pressure. Hence, $F_L$ is multiplied by a gain of $1/A_a$ in block 56 to produce the differential load pressure $P_1$–$P_2$. This pressure is then multiplied by the ratio of the spool end face area to the stub shaft end face area, this being represented by $A_f/A_s$ in block 58, to produce an equivalent differential pilot pressure. This pilot pressure is then multiplied by an appropriate gain, represented by $K_p$ in block 59, to produce an equivalent pilot-stage flow $Q_{P2}$, which is supplied as a negative input to summing point 55. The actuator position $X_a$ is shown as being supplied as the negative feedback signal, via intermediate gain K in block 43, to summing point 30.

FIG. 4C depicts the pressure-flow characteristics of the improved servovalve. As will be readily apparent from a comparison of FIG. 4C with FIG. 1C, improved valve has pressure-flow characteristics which approximate those of the conventional "flow-control" servovalve. Thus, the improved valve has a high pressure gain at small currents, but nevertheless affords ready access to an electrical signal which is substantially proportional to load pressure differential.

Figure 4D:
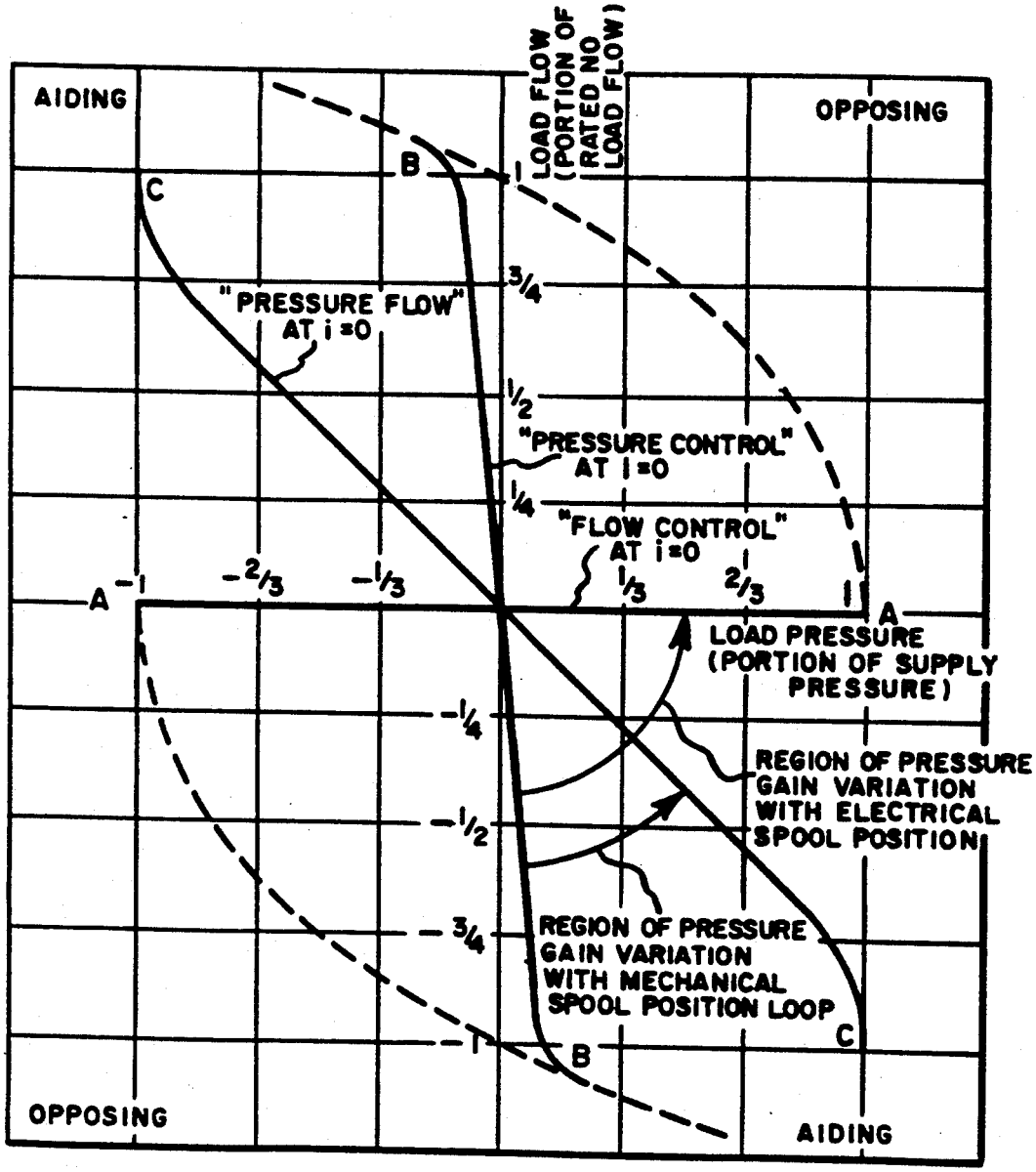
FIG. 4D is a graph comparing the pressure-flow characteristics of the "flow control", "pressure control" and "pressure-flow" servovalves, showing the range of pressure gain heretofore possible with mechanical position feedback, and also shows the extended range possible to achieve with electrical feedback.

FIG. 4D is a graph comparatively illustrating the pressure-flow characteristics of the three prior art servovalves at zero current. The dashed line issuing from $\Delta P=+1$ into the first and second quadrants, and the dashed line issuing from $\Delta P=-1$ into the third and fourth quadrants, represent the square root flow characteristic at maximum valve opening, according to equation (1). Curve A—A shows the P–Q characteristic of a "flow-control" servovalve, such as shown in FIG. 1C, at $i=0$. When the input current is zero, the spool of such "flow-control" servovalve is at null. Hence, the flow through the second-stage is schematically shown as being zero, regardless of the load pressure differential. Actually, the point from which the family of curves emanates lies in the fourth quadrant, slightly below the abscissa, such that the actual pressure gain is not infinite. However, for conceptual purposes, curve A—A is shown as being substantially coincident with the abscissa. Thus, the "flow-control" servovalve has a high pressure gain (i.e., ratio of load pressure differential to current) at zero current.

Curve B—B shows the null (i.e., $i=0$) P–Q characteristics of a "pressure-control" servovalve, such as shown in FIG. 2C. This particular curve typifies only one of a whole family of curves possible for different current inputs. Curve B—B is a substantially-vertical curve which, at its upper and lower ends, asymptotically approaches the dashed line envelope curves in the second and fourth quadrants, and asses through the origin when the load pressure differential is zero. Thus, when $i=0$, and the load pressure differential is also zero, there will be no flow through the valve. The horizontal spacing between curve B—B and the ordinate represents the pressure drip through the second-stage of the valve, Unlike curve A—A, it should be noted that the pressure gain of "pressure-control" curve B—B is very low, approaching zero.

Curve C—C shows the null P–Q characteristics of a prior art "pressure-flow" servovalve, such as shown in FIG. 3C. Moreover, curve C—C is intended to represent a situation in which the individual gains in the mechanical spool position loop (i.e., $K_M$, $K_{QP}$, $K_f$) were maximized in a practical sense. Hence, curve C—C approximates the maximum pressure gain obtainable by maximizing the individual component gains within the confines of realistic mechanically-adjustable limitations. Obviously, there are limits on the mechanical stiffness of the flapper, represented by a gain of $1/K_M$ in block 35, upon the pilot-stage flow gain, represented by a gain of $K_{QP}$ in block 36, and upon the stiffness of the mechanical feedback spring wire, represented by a gain of $K_f$ in block 39, all of which are dependent upon the maximum practical output of the torque motor. Hence, within the confines of variation among the individual elements of the spool position loop, the overall pressure gain of a servovalve having a mechanical spool position feedback loop was, as a practical matter, limited to a certain maximum value, as represented by curve C—C. Thus, the individual gains of the various mechanical elements in such "pressure-flow" servovalve could be selectively varied so that the overall pressure gain of the servovalve would be either minimized, in which case its $i=0$ curve would substantially track the linear portion of curve B—B, or maximized, in which case its $i=0$ curve would be in the position represented by curve C—C. Simply stated, the i=0 curve of such a "pressure-flow" servovalve was confined to the sector-shaped region between curves B—B and C—C, depending on the particular gains of the various elements in the mechanical spool position loop. Because of the practical limits on varying these individual gains, it was not possible to vary the pressure gain of the servovalve beyond the point represented by curve C—C. Hence, it was not possible to provide a mechanical spool position "pressure-flow" servovalve having a pressure gain greater than that approximated by curve C—C in FIG. 4D.

However, by providing an electrical spool position loop, the ability to vary the individual gains of the spool position loop elements is free from the constraints heretofore present with such mechanically-limited variables. The electrical gain is readily capable of wide variation, limited only by servo-mechanism stability, and is not limited by practical mechanical constraints. Hence, with the improved valve, it is possible to provide an improved servovalve having its PQ characteristic curve at i=0 lying virtually anywhere between curves B—B and A—A in FIG. 4D, simply by changing the electrical loop gain, and, in particular, the driving amplifier gain, $G_v$. Hence, the individual electrical components of the spool position loop may, if desired, be selectively adjusted such that the pressure-flow characteristics of the improved servovalve approach those of a conventional "flow-control" servovalve. This offers the advantage of affording the capability of high pressure gain at low currents to overcome static or threshhold friction, and performance generally comparable to that of a conventional "flow-control" servovalve. At the same time, the current supplied to the torque motor will be substantially proportional to the load pressure differential. For example, this feature may be particularly useful in equalizing the operation of two or more servovalves which are used to drive a common load. If the pressure differentials produced by such valves are mismatched, or the forces produced thereby are unbalanced, the discrepancy therebetween may lead to force-fighting at the load. However, with the improved valve, the electrical current supplied to the torque motor of each valve will be proportional to the load pressure differential. Hence, the respective currents supplied to such servovalves may be readily monitored and selectively adjusted to equalize, balance or otherwise adjust the effect on the load, as desired.

Another significant advantage of using electrical position feedback is the ability to continuously and actively adjust the effective pressure gain of the servovalve by changing the electrical gain. Hence, the drive amplifier gain $G_v$ could contain frequency dependent compensation which could, for example, provide high pressure gain at low frequencies, but reduced pressure gain in the vicinity of an actuator load resonance. Hence, dynamic pressure feedback may be implemented in a much simpler, more flexible form.

Therefore, while a preferred form of the improved valve has been shown and described, and several modifications thereof discussed, persons skilled in this art will readily appreciate that various additional changes and modifications may be made without departing from the spirit of the invention, as defined and differentiated by the following claims.

I claim:

1. A two-stage four-way electrohydraulic servovalve associated with a fluid-powered load, said servovalve being associated with a fluid source and a fluid return and arranged to control flows of fluid through two control ports with respect to said load, said servovalve having a pilot-stage adapted to be supplied with electrical current and operative to produce a pilot-stage pressure differential proportional to said current, and having a second-stage valve member mounted for movement relative to a body to vary the areas of orifices through which fluid will flow with respect to said load, comprising:

a pressure servoloop closed about said load and said second-stage valve member but not said pilot stage, said pressure servoloop being operative to cause said second-stage to produce a second-stage pressure differential proportional to said pilot-stage pressure differential; and an electrical position servoloop closed about said second-stage valve member and said pilot stage, said position servoloop being operatively to arrange to produce a valve member position error signal as the algebraic sum of a valve member position command signal and a negative valve member position feedback signal, said position error signal being amplified to supply current to said pilot-stage proportional to said position error signal;

the amplification of said position error signal being such as to cause said servovalve to substantially have the pressure-flow characteristics of a conventional flow-control servovalve in response to said position command signal;

whereby the current supplied to said pilot stage will be proportional to said second-stage pressure differential.

2. A two-stage four-way electrohydraulic servovalve as set forth in claim 1 wherein said valve member is a valve spool mounted for linear sliding movement relative to said body.

3. A two-stage four-way electrohydraulic servovalve as set forth in claim 1 wherein said pilot-stage includes a torque motor.

4. A two-stage four-way electrohydraulic servovalve as set forth in claim 1 wherein said pressure servoloop is arranged to produce a pressure error signal as the algebraic sum of a pressure command signal and a negative pressure feedback signal.

5. A two-stage four-way electrohydraulic servovalve as set forth in claim 4 wherein said pressure servoloop is hydro-mechanical.

6. A two-stage electrohydraulic servovalve associated with a fluid-powered load, said servovalve being associated with a fluid source and a fluid return and arranged to control a flow of fluid through a control port with respect to said load, said servovalve having a pilot-stage adapted to be supplied with electrical current and operative to produce a pilot-stage pressure proportional to said current, and having a second-stage valve member mounted for movement relative to a body to vary the area of at least one orifice through which fluid will flow with respect to said load, comprising:

a pressure servoloop closed about said load and said second-stage valve member but not said pilot-stage, said pressure servoloop being operative to cause said second-stage to produce at least one second-stage output pressure responsive to said pilot-stage pressure; and an electrical position servoloop closed about said second-stage valve member and said pilot-stage, said position servoloop being operatively arranged to produce a valve member position error signal as the algebraic sum of a valve member position command signal and a negative valve member position feedback signal, said position error signal being amplified to supply current to said pilot stage proportional to said position error signal;

the amplification of said position error signal being such as to cause said servovalve to substantially have the pressure-flow characteristics of a conventional flow-control servovalve in response to said position command signal;

whereby the current supplied to said pilot-stage will be proportional to said second-stage output pressure.

7. A two-stage electrohydraulic servovalve as set forth in claim 6 wherein said valve member is a valve spool mounted for linear sliding movement relative to said body.

8. A two-stage electrohydraulic servovalve as set forth in claim 6 wherein said pilot-stage includes a torque motor.

9. A two-stage electrohydraulic servovalve as set forth in claim 6 wherein said pressure servoloop is arranged to produce a pressure error signal as the algebraic sum of a pressure command signal and a negative pressure feedback signal.

10. A two-stage electrohydraulic servovalve as set forth in claim 9 wherein said pressure servoloop is hydro-mechanical.

* * * * *